US007090428B2

(12) United States Patent
Hinojosa

(10) Patent No.: US 7,090,428 B2
(45) Date of Patent: Aug. 15, 2006

(54) PROTECTOR FOR SAFETY RAILS

(75) Inventor: Luciano Hinojosa, Barcelona (ES)

(73) Assignee: Tecus Plasticos, S.L., Barcelona (ES)

( * ) Notice: Subject to any disclaimer, the term of this patent is extended or adjusted under 35 U.S.C. 154(b) by 0 days.

(21) Appl. No.: 10/724,390

(22) Filed: Nov. 26, 2003

(65) Prior Publication Data

US 2004/0234333 A1 Nov. 25, 2004

(30) Foreign Application Priority Data

Nov. 28, 2002 (ES) ..... 200202739

(51) Int. Cl.
*E01F 15/00* (2006.01)
*E01F 13/00* (2006.01)

(52) U.S. Cl. ..... 404/6; 404/9; 256/13.1; 52/736.4

(58) Field of Classification Search ..... 404/6, 404/9; 52/736.3, 736.4; 256/13.1
See application file for complete search history.

(56) References Cited

U.S. PATENT DOCUMENTS 1,101,307 A * 6/1914 McDonough ..... 52/298
2,153,384 A * 4/1939 Mazza ..... 473/443
3,104,875 A * 9/1963 Doyle ..... 267/140
3,141,655 A * 7/1964 Platt ..... 404/6
3,372,552 A * 3/1968 Liddell ..... 405/215
3,643,924 A * 2/1972 Fitch ..... 256/13.1
3,831,941 A * 8/1974 Pease ..... 267/116
3,963,218 A * 6/1976 Glaesener ..... 256/13.1
4,244,156 A * 1/1981 Watts, Jr. ..... 52/746.1
5,369,925 A * 12/1994 Vargo ..... 52/244
5,497,723 A * 3/1996 Chase ..... 114/219
D380,274 S * 6/1997 Stamets ..... D25/38
5,915,876 A * 6/1999 Barbazza ..... 404/6
6,010,275 A * 1/2000 Fitch ..... 404/6
6,494,640 B1 * 12/2002 Roller ..... 404/6
6,622,451 B1 * 9/2003 Ellis ..... 52/736.4

* cited by examiner

*Primary Examiner*—Raymond Addie
(74) *Attorney, Agent, or Firm*—Kirkpatrick & Lockhart Nicholson Graham LLP

(57) ABSTRACT

A safety protector for application on vertical posts (6) tied-down to the ground and that constitute corrugated sheet supports with safety rail barrier functions, establishing a separation between its lower edge and the ground, through which a person involved in an accident due to sliding over the asphalt may impact on the corresponding section of the vertical support post (6). The safety support is constituted by an extruded profile (1) that is assembled to be adapted as a cover on post (6), the latter having internal partitions (1) and re-thickened zones, as well as an internal sinuous profile to be adapted on corresponding post (6), externally providing impact areas for persons involved in accidents that reduces the violence and diminishes the impact force, efficiently damping the latter.

13 Claims, 2 Drawing Sheets

PROTECTOR FOR SAFETY RAILS

OBJECT OF THE INVENTION

The present invention refers to a safety protector provided for application on vertical supports on which classical safety rails, that divide circulation lanes on roads are attached, said supports being generally constituted by metallic profiles or posts with double "T" shape and in some cases in "U" shape.

The object of the invention is to provide a safety protector that is applied in enveloping manner on the vertical support posts of the safety rails, thus constituting damping means against impact that persons may experiment in traffic accidents, all this so as to prevent unrepairable damages and even death that in some cases are practically unavoidable.

BACKGROUND OF THE INVENTION

Generally, the protection barriers between lanes that are set-up on roads are constituted by a stamped sheet or part with preferably corrugated configuration as safety rail element, that is placed at a certain height as regards the ground, and against which, vehicles can impact in case of accidents, in such a manner, that these corrugated plates or safety rails are attached by means of screws to vertical posts established on the ground, said posts having in some cases an "H" configuration and in other cases a "U" configuration.

This safety protection rail system is functionally effective, since it is constructed with an economic material, of proved efficacy, and since it is of metallic nature, its integrating parts provide the protection system or safety rail with extreme strength and toughness.

Therefore, these theoretical advantages related to its use, are minimized versus the lack of protection against particular accidents, specifically those produced by persons circulating on motorbikes and/or two wheeled vehicles, who, faced with an accident are logically propelled, impacting on the first obstacle found after sliding over the asphalt.

It is evident, that if this obstacle is one of the safety rails support posts, due to the profile design that constitutes the post and the high speed of movement of the person involved in the accident, the direct collision implies the practically certain death of the person in the accident, and in the best of cases, and with luck, the damage toll of an accident of these characteristics may be a traumatic amputation of a body-member.

DESCRIPTION OF THE INVENTION

The safety protector that is recommended has been conceived in order to solve the previously described problem, based on a simple solution though of great efficacy, since it consists of a body formed by an extruded profile that adapts around the outside surface of the vertical safety rail support post, this profile constituting the protector provided with an externally circular configuration, with an open section to permit the assembly on the corresponding post, by its housing inside the protector profile, which is internally sinuous so as to adapt and attach on the actual post, also including a series of partitions or ribs that provide the assembly with great impact strength, also providing an alveolar structure that effectively dampens any impact received within the parameters for which it was designed.

Specifically, the alveolar structure is carried out on a wide area that is most likely to receive the impact, whilst the alveolar structure is of less width in an area of probable impact, whilst the rest or area with less probability of impact is where the protector is open at its circumferential contour.

The interior design of the protector assures the progressive protection of the impact, reducing the speed of the same and dissipating the strength of the impact, in such a manner, that when it is applied on the post, it is tolerable for the person involved in the accident.

Said protector constitutes a simple cover of the safety rail support post, with the purpose that, faced with the impact on the post of any person involved in an accident after sliding over the asphalt, said impact is not produced directly on the post but on said post protector or covering, as has been described.

Thus, when a person involved in an accident, impacts on a safety rail support post provided with the safety protector of the invention, his body shall receive less impact than he would receive against the post and even that which he would receive against a solid body, with the particularity that the force of impact would never be between the person involved in the accident and the post, totally or definitely cancelling the risk of cuts or amputations.

DESCRIPTION OF THE DRAWINGS

In order to complement the description being made and with the object of aiding a better understanding of the characteristics of the invention, according to a preferred practical embodiment example of the same, a set of drawings, in which with illustrative and non limitative character the following has been represented, is enclosed, forming integral part of said description

PREFERRED EMBODIMENT OF THE INVENTION

Figure 1:
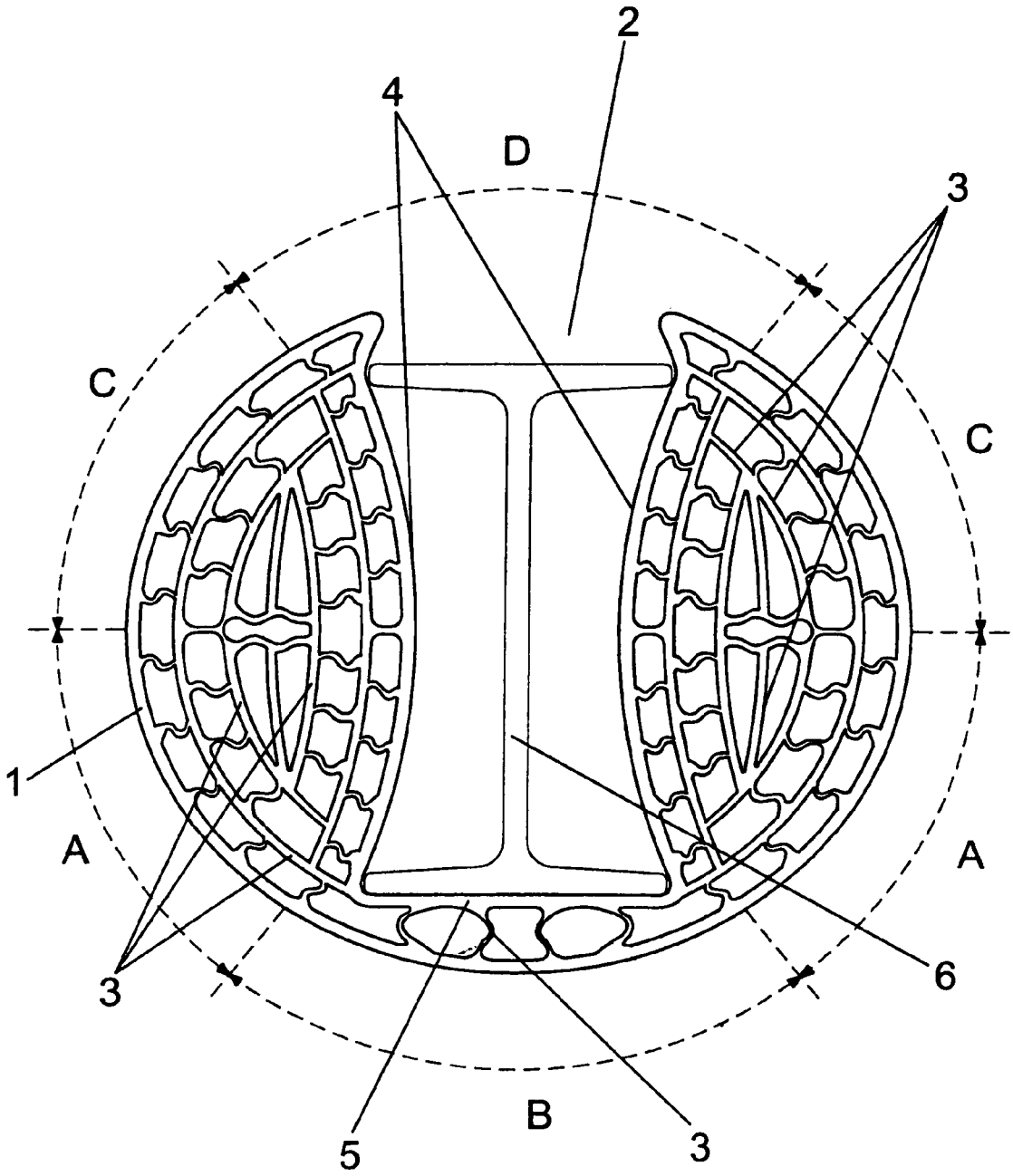
FIG. 1 shows a representation of the manner of adaptation of the safety protector that is the object of the invention, on a post with double "T" shape.
Figure 2:
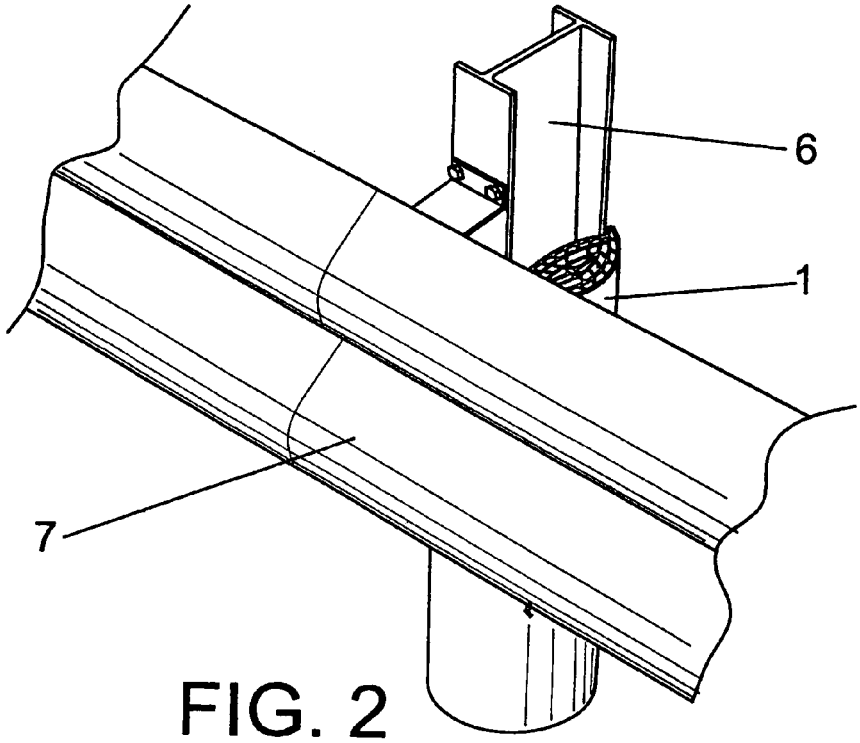
FIG. 2 shows a front perspective view of a safety rail with a support column that has its a lower section covered with the safety protector that is the object of the invention.
Figure 3:
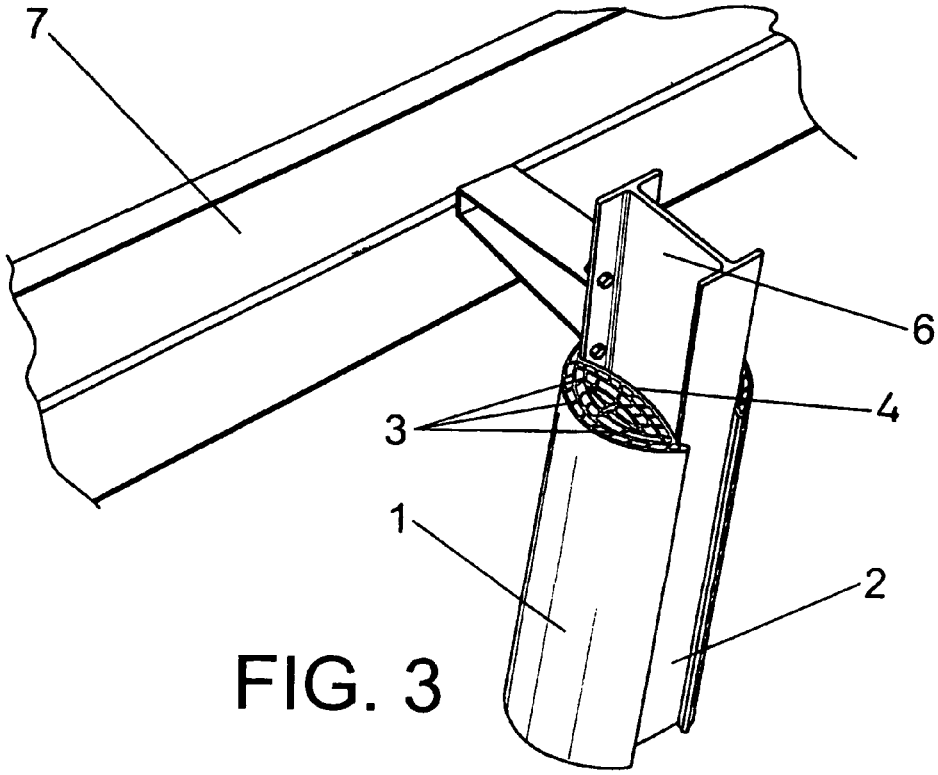
FIG. 3 finally shows another perspective view, in this case, on the rear part of the detail represented in the previous figure, where it can be observed how in this rear part, the circular profile that constitutes the safety support is open, to permit through this opening, the assembly and placement of the same on said post.

In view of the described figures it can be observed how the safety protector that is the object of the invention is constituted by a body or extruded profile (1) with circular cross-section, though with an open section (2), internally presenting a sinuous profile in which are determined, by means of corresponding stiffening partitions (3), a series of alveoli as can be clearly seen in FIG. 1, in such a manner, that two parts (4) exist, with greater width or thickness and a part of less width, the latter remaining opposite the open section (2) of the extruded profile that constitutes the actual safety protector.

This configuration permits the assembly and adaptation of the extruded profile (1) on post (6) in double "T" as support of a safety barrier-rail (7), constituted by a stamped and corrugated sheet, as is conventional.

It is evident that between the lower edge of this stamped sheet (7) that constitutes the safety rail and the ground, a separation is determined which permits that a person involved in a motorbike or two wheeled vehicle accident, passes by sliding, under said safety rail (7) and may impact on the support post (6) vertically tied-down on the ground, this lower section of said post (6) being where the safety protector that constitutes the described extruded profile (1) is assembled.

In FIG. 1, and in compliance with the assembly of the protector on the post, areas A, B, C and D have been marked, in such a manner, that the sections corresponding to area A are those of extremely probable impact, due to the situation or orientation of its assembly on the post (6) whilst the area corresponding to section B is of probable impact, though not so probable as in the previous case, whilst the areas corresponding to section C are areas of reduced probability impact. Finally, the area corresponding to section D is an area of very improbable impact, that is why it corresponds to an open part for its assembly on post (6).

The covering that constitutes the safety protector (1) on the support post (6) of safety rails (7) that are mounted on circulation lanes or roads, constitutes an element that may be easily assembled and with minimum effort on post (6), and may be removed at any moment, with the particularity, that in virtue of the ribs (3) and of the internal, sinuous, extruded profile configuration that constitutes the safety protector and of the major or minor width of the different internal areas of the same, provides the assembly with great impact strength, efficiently damping, in virtue of the alveolar and internal configuration, any impact received within the parameters for which it has been designed, providing a notable protection to persons involved in accidents, and is even capable of bearing strengths of up to 120 Kg at 150 Km/hour. That is to say, the extruded profile (1) that constitutes the protector assures the progressive absorption of the impact, reducing its violence, since it avoids direct contact of the body of the person involved in the accident and the metallic body of the vertical support post.

What is claimed is:

1. A protector for the vertical support posts of a safety rail barrier for vehicles, the safety rail barrier comprising a stamped sheet rail supported on a plurality of metallic channel-shaped support posts fixed into the ground, the posts optionally having a double-"T"- or "U"-shaped cross-section wherein the safety rail is supported above the ground with a separation between the lower edge of the rail and the ground exposing a portion of the vertical post to possible ground-sliding contact by an accident victim wherein the protector comprises an integral body having an extruded outer profile configured to surround a respective support post except for a vertically open section wherein the integral body has a generally U-shaped internal configuration permitting the integral body to conform with and attach to the support post wherein the support post can be received through the open section and into the internal U-shaped configuration permitting assembly and placement of the protector around the support post and wherein the integral body has multiple internal partitions defining cells, the cells providing a compressible internal structure capable of absorbing shock in the event of impact by an accident victim.

2. A protector according to claim 1 wherein the integral body has a smooth outer surface, optionally formed of continuous sheet material, and, referring to a horizontal section of the integral body, the integral body has two opposed thicker parts on either side of a less thick intermediate part and wherein the protector is locatable on the respective support post so that the external surfaces of the thicker parts are disposed in external zones having a relatively high probabilities of impact and the external surface of the intermediate part is disposed in an external zone with a relatively lower probability of impact.

3. A protector according to claim 2 wherein the protector is locatable on the respective support post with the open section of the extruded profile located in an external zone of improbable impact.

4. A protector according to claim 1 wherein the outer profile of the integral body lies on a circle and the integral body is the product of an extrusion process.

5. A protector according to claim 1 wherein the internal configuration of the integral body is shaped to fit a double-"T"-shaped support post, has a pair of opposed convex curves providing a narrowing of the open section between the bars of the "T" shapes and has detents adjacent the outer profile to engage the ends of the bar of one of the support post "T" shapes and hold the integral body attached to the support post.

6. A protector according to claim 2 wherein the protector is locatable on the respective support post with the open section of the extruded profile located it an external zone of improbable impact, wherein the outer profile of the integral body lies on a circle and the integral body is the product of an extrusion process and wherein the sinuous internal configuration of the integral body is shaped to fit a double-"T"-shaped support post with convex curves providing a narrowing of the open section between the bars of the "T" shapes and with outer peripheral portions providing latches to hold the integral body attached to the support post.

7. A protector according to claim 1 in combination with the vertical support post for the safety rail barrier, the protector being mounted on and protecting the support post and having a vertically open section in the mounted position.

8. A protector according to claim 1 wherein the integral body has an sinuous-shaped, extruded internal profile.

9. A protector according to claim 1 wherein the integral body is a one-piece body.

10. A protector according to claim 1 wherein the integral body is removably attachable to the support post without requiring an additional fastening device.

11. A protector according to claim 1 wherein the integral body has an sinuous-shaped, extruded internal profile, is a one-piece body and is removably attachable to the support post without requiring an additional fastening device.

12. A protector according to claim 5 wherein the integral body has an sinuous-shaped, extruded internal profile, is a one-piece body and is removably attachable to the support post without requiring an additional fastening device.

13. A safety rail barrier supported by a plurality of cushioned support posts, fixed into the ground, the posts alternatively having a double T- or U-shaped cross-section, wherein the safety rail is supported above the ground creating a spacing above the ground, thus exposing the cushioned supports posts to possible impact by vehicle accident victims; the cushioned support posts each comprising:

A protector for encircling the support post within said above ground spacing; the protector having an integral body portion including a plurality of internal, cell defining partitions, the cells providing a compressible internal structure capable attenuating damage to an accident victim, having an extruded outer profile, and generally U-shaped internal profile that permits the support post to be received through a vertically open section of said integral body portion, wherein the internal profile conforms with and attaches to said support post, thus permitting assembly and placement of the protector around said support post.

* * * * *